US011286613B2

(12) United States Patent
Bunch

(10) Patent No.: US 11,286,613 B2
(45) Date of Patent: Mar. 29, 2022

(54) IRONING CENTER

(71) Applicant: DROPOUT CABINET FIXTURES, LLC, Morgan Hill, CA (US)

(72) Inventor: Clinton Merle Bunch, Morgan Hill, CA (US)

(73) Assignee: Dropout Cabinet Fixtures, LLC, Santa Clara, CA (US)

( * ) Notice: Subject to any disclaimer, the term of this patent is extended or adjusted under 35 U.S.C. 154(b) by 992 days.

(21) Appl. No.: 15/410,608

(22) Filed: Jan. 19, 2017

(65) Prior Publication Data

US 2017/0204557 A1 Jul. 20, 2017

Related U.S. Application Data

(60) Provisional application No. 62/388,171, filed on Jan. 19, 2016.

(51) Int. Cl.

| | |
|---|---|
| ***D06F 79/02*** | (2006.01) |
| ***A47B 88/42*** | (2017.01) |
| ***A47B 46/00*** | (2006.01) |
| ***A47B 88/437*** | (2017.01) |
| ***A47B 88/477*** | (2017.01) |
| ***D06F 81/02*** | (2006.01) |
| ***D06F 81/06*** | (2006.01) |
| ***A47B 5/04*** | (2006.01) |
| ***A47B 61/00*** | (2006.01) |

(52) U.S. Cl.

CPC ..... *D06F 79/02* (2013.01); *A47B 5/04* (2013.01); *A47B 46/00* (2013.01); *A47B 61/003* (2013.01); *A47B 88/42* (2017.01); *A47B 88/437* (2017.01); *A47B 88/477* (2017.01); *D06F 81/02* (2013.01); *D06F 81/06* (2013.01)

(58) Field of Classification Search

CPC ..... D06F 79/02; D06F 81/02; D06F 81/04; D06F 81/06; A47B 88/42; A47B 88/437; A47B 88/477; A47B 46/00

USPC ..... 312/21–30; 108/33–49

See application file for complete search history.

(56) References Cited

U.S. PATENT DOCUMENTS

| | | | | |
|---|---|---|---|---|
| 960,213 | A | 5/1910 | Williams | |
| 1,207,268 | A | 12/1916 | Blanchard | |
| 1,480,817 | A | 1/1924 | Dixon | |
| 1,532,312 | A | 4/1925 | Hurd | |
| 1,560,962 | A | 11/1925 | Agee | |
| 1,568,376 | A | 1/1926 | Grant | |
| 1,581,428 | A | 4/1926 | Cummings | |
| 1,699,766 | A * | 1/1929 | Starr | D06F 81/06 108/48 |
| 1,796,569 | A | 3/1931 | Madsen | |
| 1,849,184 | A | 3/1932 | Gay | |
| 1,886,983 | A | 11/1932 | Soucie | |
| 1,940,128 | A | 12/1933 | Howard | |
| 2,157,675 | A | 5/1939 | Rieter | |
| 2,358,906 | A | 9/1944 | Bullard | |

(Continued)

*Primary Examiner* — Nathan E Durham

(57) ABSTRACT

The present invention provides for a complete ironing center to be attached to and stored within a wall cabinet. The ironing board is deployed perpendicularly from the back wall of the cabinet. In one embodiment, the cabinet is integrated into a larger wall cabinet system. In these embodiments, the cabinet is extended from the wall cabinet and locked into an open position. This complete system is easily and quickly closed and stored out of sight within the cabinet when not in use.

18 Claims, 6 Drawing Sheets

(56) References Cited

U.S. PATENT DOCUMENTS

| | | | | | |
|---|---|---|---|---|---|
| 2,535,755 | A | | 12/1950 | Rieter | |
| 2,646,634 | A | | 7/1953 | Mongar | |
| 2,680,314 | A | | 6/1954 | Snyder | |
| 2,963,804 | A | | 12/1960 | Frechette | |
| 3,185,278 | A | * | 5/1965 | Miller | D06F 81/06 194/241 |
| 3,663,080 | A | | 5/1972 | Ayers | |
| 3,696,762 | A | | 10/1972 | Holdham | |
| 3,730,107 | A | | 5/1973 | Bergkamp et al. | |
| 3,742,868 | A | | 7/1973 | Garceau et al. | |
| 4,480,556 | A | * | 11/1984 | Wilson | D06F 81/06 108/48 |
| 4,862,811 | A | | 9/1989 | Davis | |
| 4,909,158 | A | | 3/1990 | Sorensen | |
| 4,995,681 | A | | 2/1991 | Parnell | |
| 5,468,063 | A | * | 11/1995 | Simonek | A47B 88/42 312/287 |
| 5,570,642 | A | | 11/1996 | Lehrman | |
| 6,199,966 | B1 | * | 3/2001 | Fulterer | A47B 88/42 312/270.3 |
| 6,412,423 | B1 | | 7/2002 | Elizondo, Jr. | |
| 6,684,540 | B1 | | 2/2004 | Tufts | |
| 7,062,871 | B1 | * | 6/2006 | Smidt | A47B 77/10 108/35 |
| 7,278,229 | B1 | | 10/2007 | Fen | |
| 8,272,153 | B2 | | 9/2012 | Elizondo, Jr. | |
| 8,671,598 | B2 | * | 3/2014 | Murphy | D06F 81/06 38/104 |
| 9,119,467 | B2 | | 9/2015 | Elizondo, Jr. et al. | |
| 9,565,936 | B2 | * | 2/2017 | Chen | A47B 88/57 |
| 2007/0278914 | A1 | * | 12/2007 | Verfaillie | A47B 88/42 312/226 |
| 2012/0049713 | A1 | * | 3/2012 | Tingle | A47B 88/42 312/334.33 |
| 2012/0217214 | A1 | * | 8/2012 | Thomsen | A47B 77/16 211/79 |
| 2013/0154459 | A1 | | 6/2013 | Murphy et al. | |

* cited by examiner

IRONING CENTER

RELATED APPLICATIONS

This application claims priority to U.S. Provisional Application No. 62/388,171, entitled, "Pull-Out Ironing Center," filed on Jan. 19, 2016. The disclosure of the related application is hereby incorporated by reference in its entirety.

COPYRIGHT AUTHORIZATION

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

The present invention relates generally to ironing board storage systems. More particularly, the invention relates to a cabinet storage system for improving organization, accessibility, space efficiency and convenience of necessary components and accessories for ironing. In one embodiment, the cabinet storage system is a pull-out cabinet.

BACKGROUND

Built-in ironing centers are a common feature in many homes and have been created in many different configurations over the last century but these generally require clear wall space to be either built into or attached to.

These systems generally contain reduced sized ironing boards and they are often a visually undesirable feature on the wall of the room.

DETAILED DESCRIPTION OF THE INVENTION

Generally the invention provides for a new an esthetically pleasing system for storing and using an ironing board and its associated accompaniments. By residing within a narrow space in a wall cabinet the impact on a room when not in use is negligible. When ironing is needed, access is very easy and quick; and when no longer needed it is just as efficient to put away.

Figure 1:
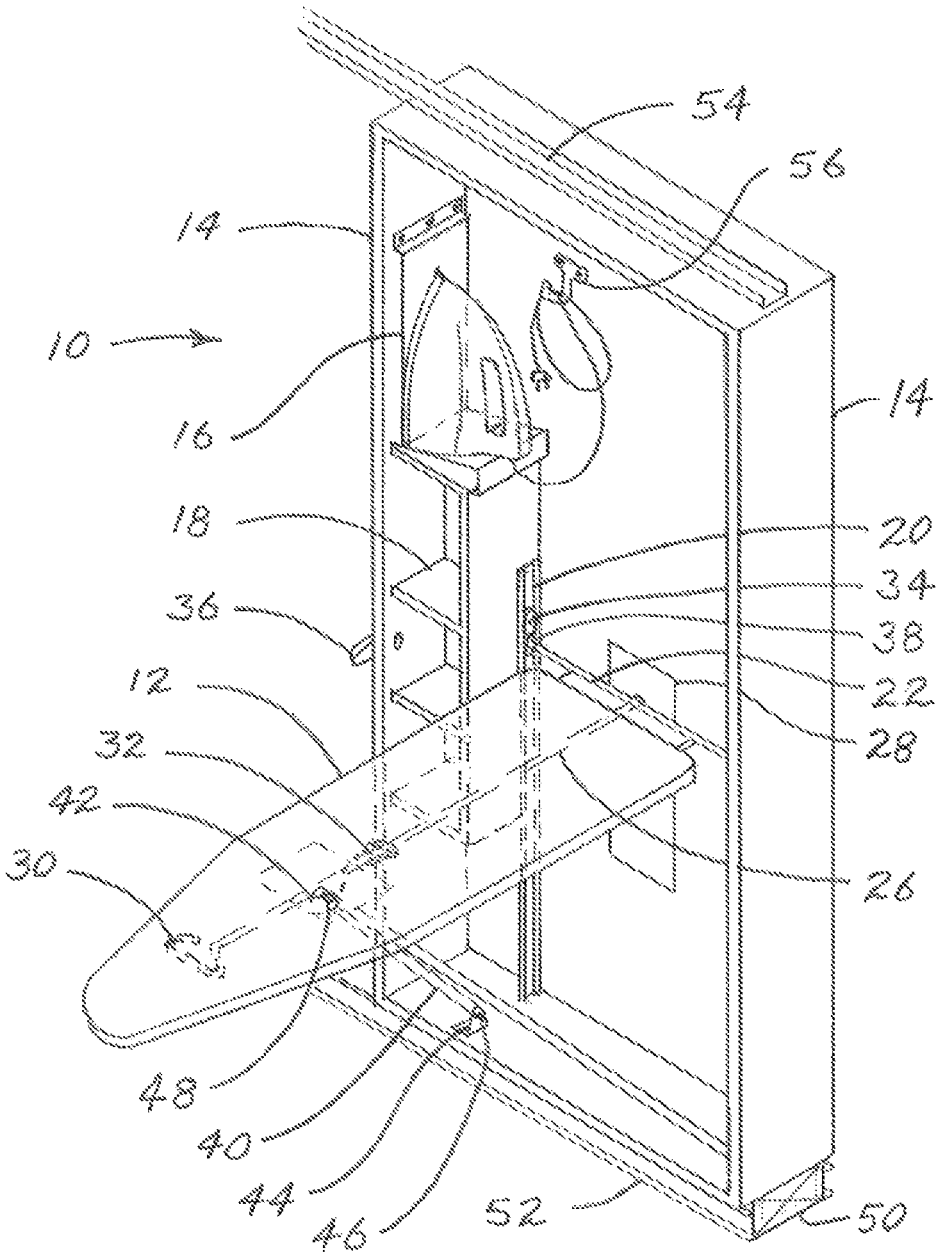
FIG. 1 is a perspective view of the ironing center with the ironing board in an extended position.
Figure 2:
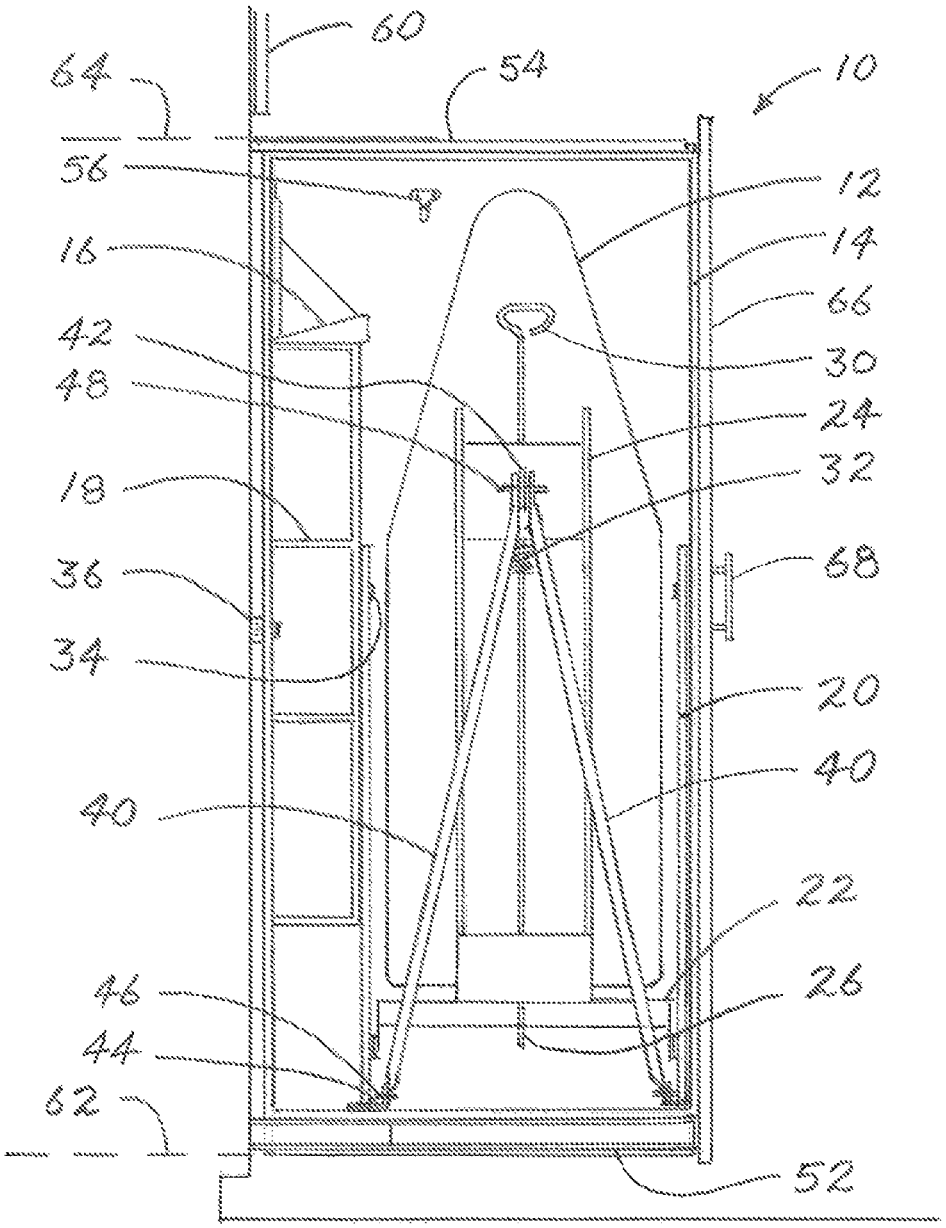
FIG. 2 is a front view of the ironing center with the ironing board in a folded up position.

Turning to the figures, FIG. 1 illustrates the ironing center 10. Ironing center 10 includes an ironing board 12 housed within a cabinet 14 which includes one back, two side walls, a top and a bottom. In one embodiment, as illustrated in the figures, cabinet 14 is a pull-out cabinet. In another embodiment, cabinet 14 is mounted to a wall. In the wall mount embodiment, cabinet 14 has a front door(s) to enclose the ironing center. Ironing board 12 has a top side which is used for ironing and a bottom side. In one embodiment, a heat resistant iron dock 16 is mounted at the top of the accessory compartment 18. In one embodiment, as illustrated in the figures, accessory compartment 18 includes several shelves, which may be used to store items regularly used when ironing. In another embodiment, the accessory compartment includes a bar to hang clothes from. Such bar may fold or telescope out to extend beyond the boundaries of cabinet 14. Two roller tracks 20 (only one illustrated in FIG. 1) guide roller frame 22 that is attached to board frame 24 located on the bottom side of the ironing board 12 (see FIG. 2). In one embodiment, as illustrated in the figures, board frame 24 has two support beams or rails. Optionally, at least one cross-member joins the two support beams or rails. In another embodiment, support frame 24 is one piece. Latch pin 26 mounts under ironing board 12 and is connected together with latch release 30. In one embodiment, as illustrated in the figures, latch pin 26 is parallel and in between the two support beams of support frame 24. In one embodiment, as illustrated in the figures, latch pin 26 and latch release 30 are one continuous length. Spring 32 engages latch pin 26 into strike plate 28. In other embodiments, spring 32 may be replaced with a different system for keeping the latch pin 26 in strike plate 28, for example, a lever lock or rotating lever lock. In one embodiment, latch pin 26 engages in a depression or hole in strike plate 28. In another embodiment, latch pin 26 engages with a flange on strike plate 28. In another embodiment, strike plate 28 has multiple locations in which latch pin 26 engages to allow for a use to adjust the height of the ironing board. Stop bumpers 34 (only one illustrated in FIG. 1) limit the distance of travel of rollers 38 (only one illustrated in FIG. 1) in roller tracks 20. In one embodiment, the location of stop bumper 34 is adjustable to allow a user to adjust the height of the ironing board. Rollers 38 are attached to roller frame 22. In pull-out cabinet embodiments, stability latch 36 locks the cabinet 14 in the open position when being used. Two support legs 40 attach to two leg base brackets 44 and apex bracket 42 (see FIG. 2) in a manner that allows the legs to pivot at the attachment points. The base brackets 44 are attached to the bottom of cabinet 14 and the apex bracket is attached to the bottom side of ironing board 12. In the adjustable height embodiments, the location of the apex bracket is adjustable. The two board support legs 40 pivot on two base pivot pins 46 and apex pivot pin 48 (see FIG. 2).

In the pull-out embodiment, cabinet 14 mounts to base mount 50 which is attached to and rides on base slide 52. Top slide 54 is located at the top of pull-out cabinet 14. In one embodiment, cord hook 56 is attached to the inside of cabinet 14 near iron dock 16.

Figure 3:
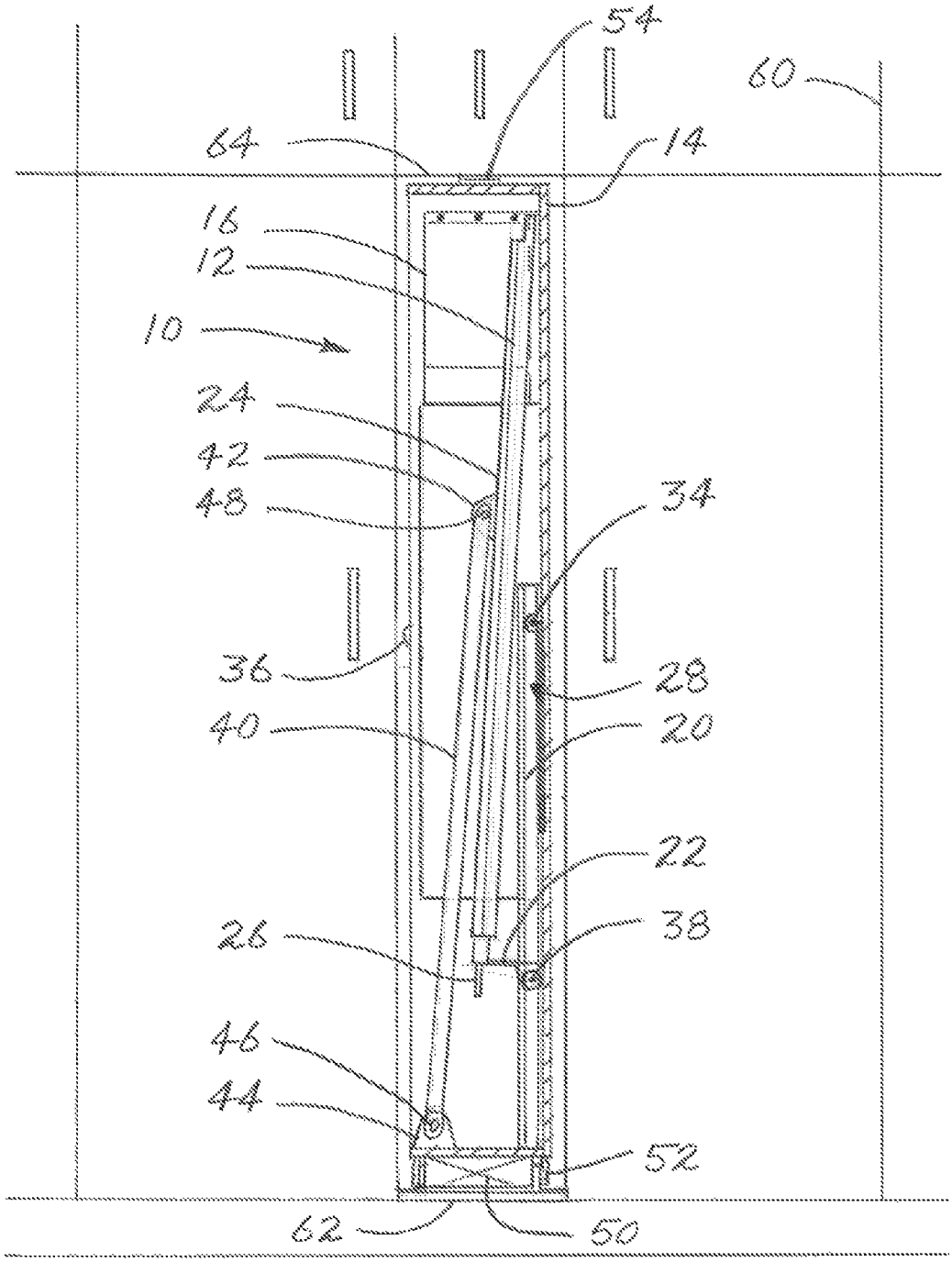
FIG. 3 is a side view of the ironing center with the ironing board in a folded up position.
Figure 4:
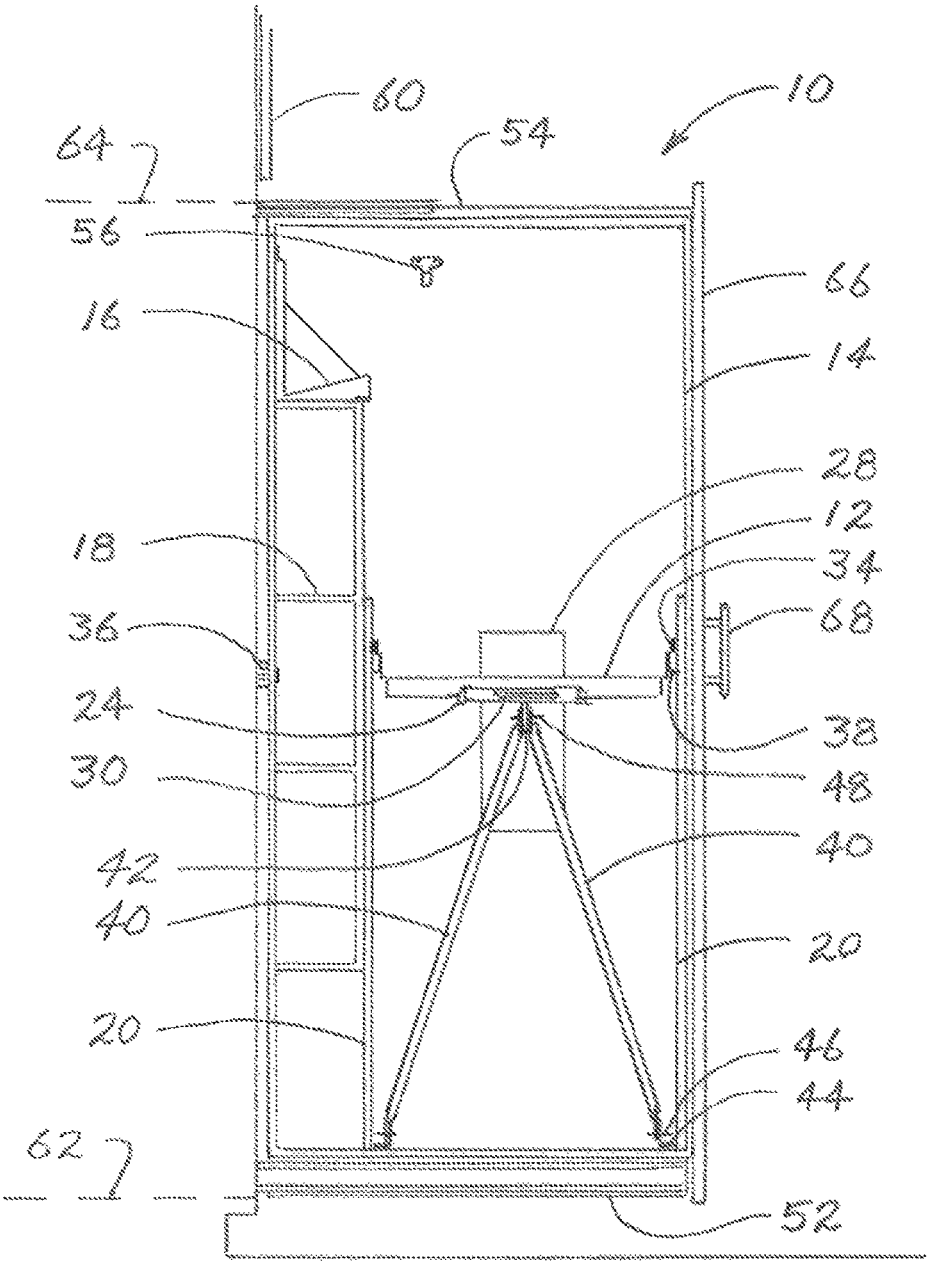
FIG. 4 is a front view of the ironing center with the ironing board in an extended position.
Figure 5:
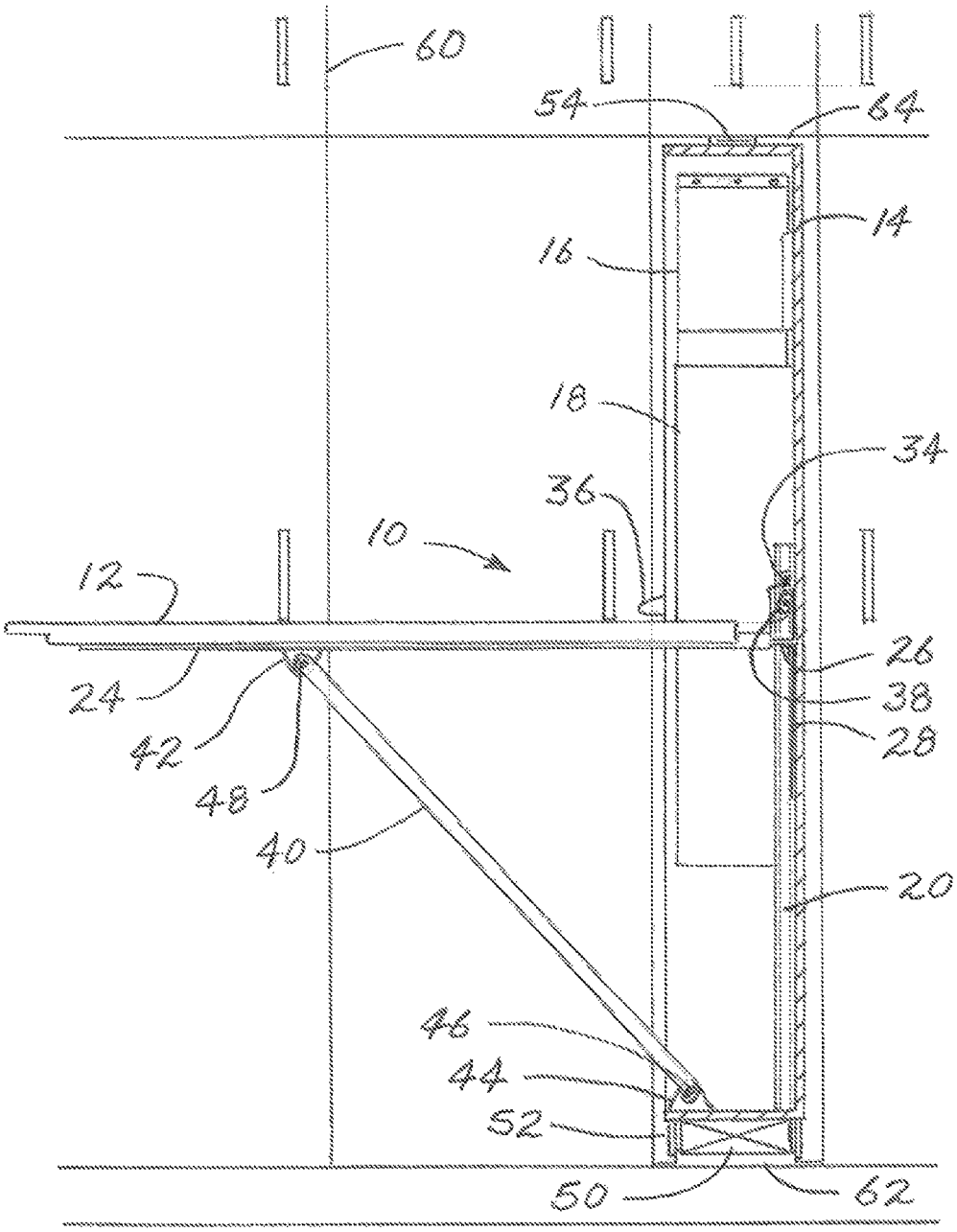
FIG. 5 is a side view of the ironing center with the ironing board in an extended position.

FIG. 3 illustrates the pull-out embodiment of ironing center 10 as it is installed in typical wall cabinets 60. Base slides 52 are fastened to the bottom 62 of wall cabinets 60 and top slide 54 is fastened to top 64 of compartment in wall cabinets 60. A door panel 66 and handle 68 would typically be applied to the pull-out cabinet 14 to conceal ironing center 10 within typical wall cabinets 60 and facilitate easy access to the ironing center 10.

FIG. 1 illustrates the pull-out embodiment of the ironing center as it would be used after having been withdrawn from its closed position within a cabinet, stability latch set and ironing board deployed.

The pull-out feature of the present invention overcomes space and aesthetic issues by fitting into a wall or wall cabinet in a sideways configuration. This arrangement enables the ironing center to be completely contained behind a very narrow door. In one embodiment, the door panel is less than 18 inches wide. In another embodiment, the door panel is less than 12 inches wide. In yet another embodiment, the door panel is less than 10 or 8 or 6 inches wide.

Figure 6:
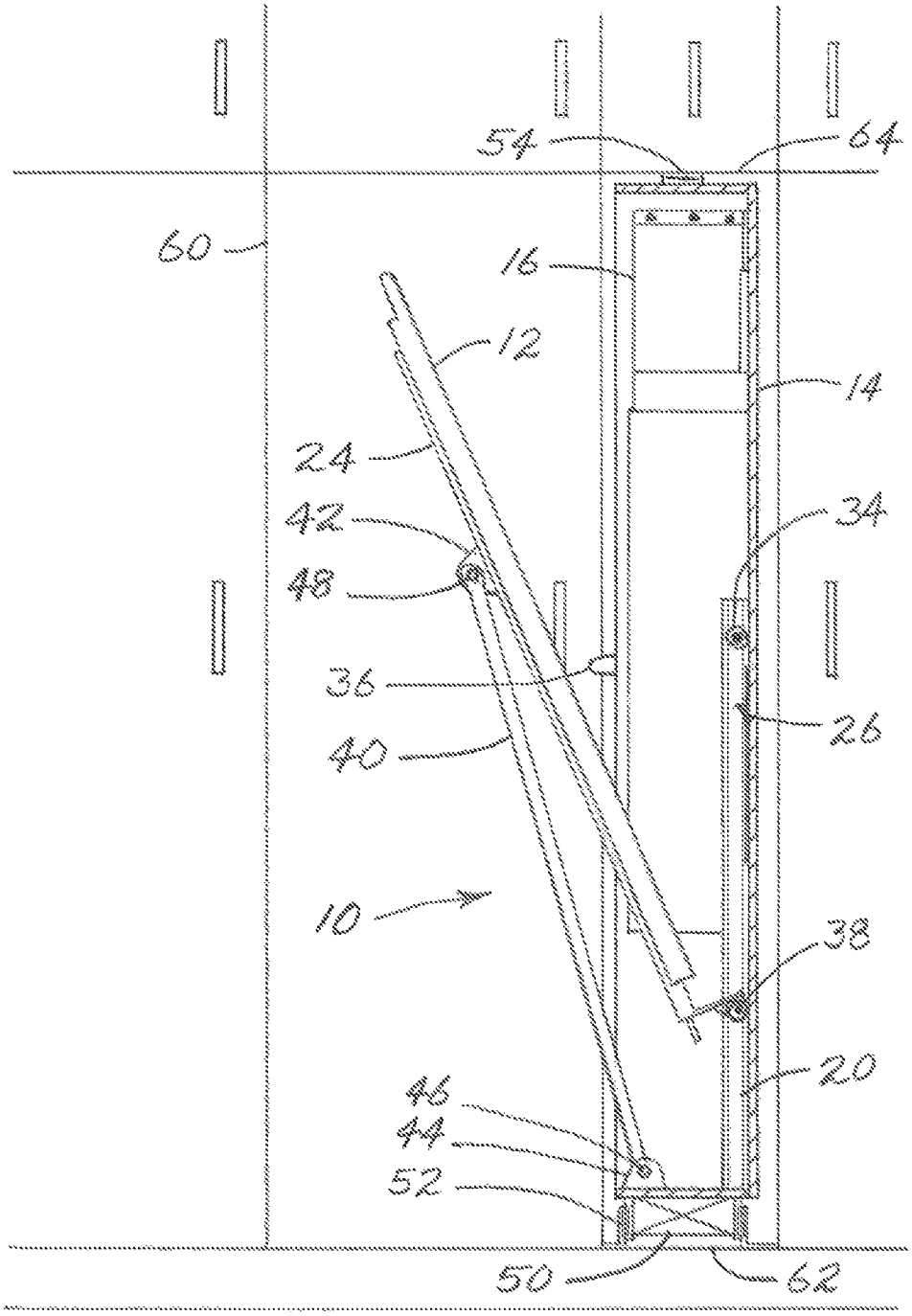
FIG. 6 is a side view of the ironing center with the ironing board in a partially extended position.

Once the ironing center cabinet is pulled out into the room it is latched into a stationary position by applying a stability latch 36 and then pulling the top of the ironing board 12 forward and the bottom up until latch pin 26 catches on strike plate 28 (see FIG. 6).

To put the pull-out ironing center away the user will pull the latch release 30 and move the extended end of the ironing board 12 upward and into the pull-out cabinet 14. Release the stability latch 36 and return the whole unit back into the stored position within the wall cabinet where it will blend in seamlessly with other adjacent cabinetry.

One objective of the present invention is to provide the consumer with a compact, space efficient and very convenient complete ironing center that can be an accessory cabinet component integrated into cabinetry.

In the preferred embodiment this pull-out ironing center will be sized to contain a full size ironing board and spaces for storage of ironing accessories and an iron dock for safe storage of and a convenient location for a standard household iron.

Furthermore, it is an object of this application to illustrate the preferred embodiments and broadly state the methodologies that may be used in order to facilitate the assemblies of a complete ironing center into a narrow portion of wall cabinets.

While various embodiments of the present invention have been described above, it should be understood that they have been presented by way of example only, and not of limitation. Likewise, the various diagrams may depict an example architectural or other configuration for the invention, which is done to aid in understanding the features and functionality that can be included in the invention. The invention is not restricted to the illustrated example architectures or configurations, but the desired features can be implemented using a variety of alternative architectures and configurations. Indeed, it will be apparent to one of skill in the art how alternative functional, logical or physical partitioning and configurations can be implemented to implement the desired features of the present invention. Also, a multitude of different constituent module names other than those depicted herein can be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the invention may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The use of the term "module" does not imply that the components or functionality described or claimed as part of the module are all configured in a common package. Indeed, any or all of the various components of a module, whether control logic or other components, can be combined in a single package or separately maintained and can further be distributed across multiple locations.

What is claimed:

1. An ironing center assembly for mounting to a planar surface of a wall, comprising:

a cabinet having a first side, a second side, a top, a bottom, and a back; wherein the first side, the second side, the top, the bottom, and the back form a compartment having an interior and an exterior;

an ironing board having a top surface, a bottom surface, a top end, and a bottom end;

a board frame;

two support legs each having a first end and a second end;

two base brackets;

an apex bracket;

two roller tracks, each having a stopper;

a roller frame having a first end and a second end;

a latch system comprising a latch pin having a first end and a second end and a strike plate;

a top slide mounted to the exterior side of the top of the cabinet;

a bottom slide mounted to the exterior side of the bottom of the cabinet; and a stability latch mounted on one of the first and second sides for locking the cabinet in an open position preventing the cabinet from sliding along the top slide and the bottom slide to a closed position;

wherein the two roller tracks are mounted to the interior of the first side and to the interior of the second side of the cabinet;

wherein the strike plate is attached to the interior of the back of the cabinet;

wherein the two base brackets are mounted to the interior of the bottom of the cabinet;

wherein the board frame, the apex bracket, and the latch pin are attached to the bottom surface of the ironing board;

wherein the first end of the roller frame slideably engages with the two roller tracks and wherein the stopper limits the upward movement of the roller frame;

wherein the second end of the roller frame is attached to the board frame;

wherein the first end of the two support legs are attached to the two base brackets in a manner that allows the two support legs to pivot at the attachment point;

wherein the second end of the two support legs are attached to the apex bracket in a manner that allows the two support legs to pivot at the attachment point while providing three-point stability via the two base brackets and the attachment point;

wherein the first end of the latch pin removeably engages with the strike plate;

wherein the second end of the latch pin forms a handle;

wherein the top slide and the bottom slide allow the cabinet to slide in and out of a larger second cabinet between the open and closed positions; and wherein the ironing board has (i) an extended position in which the ironing board extends out from the interior, and (ii) a closed position in which the ironing board is positioned within the interior, and in which a planar ironing surface of the ironing board is substantially perpendicular to the planar surface of the wall.

2. The ironing center assembly of claim 1, further comprising a heat resistant iron dock attached to the interior of the cabinet.

3. The ironing center assembly of claim 1, further comprising at least two shelves.

4. The ironing center assembly of claim 1, further comprising a hook for hanging items within the interior.

5. The ironing center assembly of claim 1, wherein the first side and the second side of the cabinet has a width perpendicular to the top and bottom slides of 8 inches or less.

6. A pull-out ironing center for mounting in a wall cabinet compartment mounted to a planar surface of a wall, the ironing center comprising:

a base slide configured for mounting to a bottom of the wall cabinet compartment;

a top slide configured for mounting to a top of the wall cabinet compartment;

a pull-out cabinet slidably supported by the base and top slides, the pull-out cabinet having (i) an open position extending from the base and top slides and configured to extend outwardly from the wall cabinet compartment and (ii) a closed position in which the pull-out cabinet is retracted on the base and top slides and configured to conceal the pull-out cabinet within the wall cabinet compartment, the pull-out cabinet having an interior formed by an inner side wall, an outer side wall, a top and a bottom;

an ironing board movably mounted to the pull-out cabinet, the ironing board having (i) a folded position in which the ironing board is positioned within the interior and (ii) an extended position in which the ironing board extends out from the interior; and a stability latch mounted on one of the inner side wall and the outer side wall for locking the pull-out cabinet in the open position preventing the pull-out cabinet from sliding along the base and top slide to the closed position.

7. The pull-out ironing center of claim 6, wherein the stability latch is mounted on the inner side wall of the pull-out cabinet.

8. The pull-out ironing center of claim 7, wherein when the ironing board is in the extended position, a top surface of the ironing board is at a height H relative to the bottom slide, and wherein the stability latch is mounted on the inner side wall of the pull-out cabinet approximately at the height H.

9. The pull-out ironing center of claim 6, wherein when the ironing board is in the extended position, a top surface of the ironing board is at a height H relative to the bottom slide, and wherein the stability latch is mounted to the pull-out cabinet approximately at the height H.

10. The pull-out ironing center of claim 6, wherein in the closed position, a planar ironing surface of the ironing board is substantially perpendicular to the planar surface of the wall.

11. The pull-out ironing center of claim 6, further comprising a door panel mounted on an exterior of the outer side wall for concealing the pull-out cabinet in the wall cabinet compartment when the pull-out cabinet is in the closed position, the door panel having a width that is narrower than the ironing board width.

12. The pull-out ironing center of claim 6, wherein the inner side wall, the outer side wall, the top, and the bottom all have a width perpendicular to the base and top slides that is 8 inches or less.

13. The pull-out ironing center of claim 6, further comprising a guide roller frame pivotably and slidably mounted within a pair of roller tracks mounted within the interior of the pull-out cabinet, wherein the ironing board is mounted on the roller guide frame, and wherein the roller guide frame is parallel to the base and top slides.

14. A pull-out ironing center for mounting in a wall cabinet compartment mounted to a planar surface of a wall, the ironing center comprising:

a base slide configured for mounting to a bottom of the wall cabinet compartment;

a top slide configured for mounting to a top of the wall cabinet compartment;

a pull-out cabinet slidably supported by the base and top slides, the pull-out cabinet having (i) an open position extending from the base and top slides and configured to extend outwardly from the wall cabinet compartment and (ii) a closed position in which the pull-out cabinet is retracted on the base and top slides and configured to conceal the pull-out cabinet within the wall cabinet compartment, the pull-out cabinet having an interior defined by an inner side wall, an outer side wall, a top and a bottom; and an ironing board movably mounted to the pull-out cabinet, the ironing board having (i) an extended position in which the ironing board extends out from the interior, and (ii) a closed position in which the ironing board is positioned within the interior, and in which a planar ironing surface of the ironing board is substantially perpendicular to the planar surface of the wall; and a stability latch mounted on the pull-out cabinet for locking the pull-out cabinet in the open position preventing the pull-out cabinet from sliding along the base and top slide to the closed position, wherein the stability latch is mounted on the inner side wall of the pull-out cabinet.

15. The pull-out ironing center of claim 14, further comprising a door panel mounted on an exterior of the outer side wall for concealing the pull-out cabinet in the wall cabinet compartment when the pull-out cabinet is in the closed position, the door panel having a width that is narrower than a width of the ironing board.

16. The pull-out ironing center of claim 15, wherein the inner side wall, the outer side wall, the top, and the bottom all have a width perpendicular to the slides that is less than the ironing board width.

17. The pull-out ironing center of claim 16, wherein the inner side wall, the outer side wall, the top, and the bottom all have a width perpendicular to the base and top slides that is 8 inches or less.

18. The pull-out ironing center of claim 14, further comprising a guide roller frame pivotably and slidably mounted within a pair of roller tracks mounted to the pull-out cabinet, the pair of roller tracks extending upwardly and perpendicular to the base and top slides, wherein the ironing board is mounted on the roller guide frame, and wherein the roller guide frame is parallel to the base and top slides.

* * * * *